US005152121A

United States Patent [19]

Nakamura

[11] Patent Number: 5,152,121

[45] Date of Patent: Oct. 6, 1992

[54] DISPENSER-CONTAINER FOR WET TISSUES, AND A PROCESS FOR MANUFACTURING THE SAME AND AN APPARATUS THEREFOR

[75] Inventor: Kenji Nakamura, Osaka, Japan

[73] Assignee: Kennak U.S.A. Inc., New York, N.Y.

[21] Appl. No.: 742,301

[22] Filed: Aug. 8, 1991

Related U.S. Application Data

[63] Division application Ser. No. 657,964, Feb. 20, 1991, now Pat. No. 5,076,424, which is a continuation of Ser. No. 421,285, filed Oct. 13, 1989, now abandoned.

[30] Foreign Application Priority Data

Oct. 15, 1988 [JP] Japan ..... 63-260316

[51] Int. Cl.[5] ..... B65B 63/04; A47K 10/32

[52] U.S. Cl. ..... 53/431; 53/111 RC; 53/117; 53/522

[58] Field of Search ..... 53/431, 116, 117, 121, 53/111 R, 520, 522, 430; 493/464, 407, 345, 344, 349

[56] References Cited

U.S. PATENT DOCUMENTS

| | | | |
|---|---|---|---|
| 2,541,387 | 2/1951 | Salfisberg | 53/117 X |
| 3,286,435 | 11/1966 | Weinberger | 53/431 X |
| 3,496,698 | 2/1970 | Wichmann | 53/117 |
| 3,795,355 | 3/1974 | Gerstein | 225/106 |
| 3,805,474 | 4/1974 | Gerstein | 53/431 X |
| 4,189,896 | 2/1980 | Kolbach et al. | 53/431 |
| 4,638,921 | 1/1987 | Sigl et al. | 222/1 |
| 4,649,695 | 3/1987 | Crouch et al. | 53/431 |

FOREIGN PATENT DOCUMENTS 1382183 1/1975 United Kingdom .

*Primary Examiner*—James F. Coan

*Attorney, Agent, or Firm*—Brooks, Haidt, Haffner & Delahunty

[57] ABSTRACT

A dispenser-container for wet tissues comprises wet tissues impregnated with liquid and a container, which is a cylinder, a box or a bag made of a flexible and impervious sheet, having the wet tissues contained therein. The tissues are made of a continuous sheet-like material which has weakened lines for separating therealong at a predetermined distance or are made of a plurality of short tissues, adjacent edges of which short tissues are partially overlapped with each other. The wet tissues contained in the container are formed in a rope-like or tape-like shape. Processes for manufacturing the a dispenser-container for wet tissues, and apparatuses for manufacturing the dispenser-container for wet tissues.

6 Claims, 6 Drawing Sheets

1
33
48
67a
67
56
42a
Xc
33b
66
64
Xb
60
63
Xa
50a
62
50
65
62a
62b
63a
63b
64a
64b

DISPENSER-CONTAINER FOR WET TISSUES, AND A PROCESS FOR MANUFACTURING THE SAME AND AN APPARATUS THEREFOR

This is a division of application Ser. No. 657,964, filed Feb. 20, 1991, now U.S. Pat. No. 5,076,424, which is a continuation of U.S. Ser. No. 421,285 filed Oct. 13, 1989, now abandoned.

BACKGROUND OF THE INVENTION

1. Field of the Invention

The present invention relates to a dispenser-container containing wet tissues impregnated with liquid in a container. The present invention also relates to a process for manufacturing the dispenser-containers and an apparatus for manufacturing the dispenser-containers.

2. Description of the Prior Art

Recently, wet tissues, i.e., fibrous materials, such as non-woven fabrics, woven fabrics, or gauze, impregnated with toilet water or cleaning solution including alcohol, moisturing agent or surfactant and so on, have been utilized widely for cleansing make-up, cleaning skin or wiping stains in a kitchen, for example, stains around a gas range or stains in a refrigerator.

Conventionally known dispenser-containers for wet tissues are of a pop-up type, wherein wet tissues wound in a roll are packed in cylindrical containers which can be repeatedly open and sealed, and the wet tissues are picked up from the upper portions of the cylindrical containers. (For Example, see Japanese Utility Model Publication No. Sho 48-33587.)

The rolled wet tissues are prepared by winding a long sheet-like material keeping its original width. The sheet-like material for wet tissues has a plurality of perforated lines extending transversely between both the longitudinal sides thereof and formed equidistantly along the longitudinal direction thereof. Upon use, if an end of the tissue material is pulled straightly and upwardly, the tissue material is torn at the perforated line when the portion with a perforated line passes through an aperture formed at the center of the closure of the container, and the tissue material is separated along the perforated line in individual tissues.

In the conventional container of a pop-up type, the wet tissue roll has to be stored in a condition wherein the roll axis is vertically directed, i.e., the roll axis is parallel to that of the cylindrical container, since the tissue material has to be taken up in an axial direction of the roll. Consequently, the height of the container is higher than the width of the roll. If the amount of tissues contained in the container is desired to be increased, it is the only solution to increase the diameter of the container.

As described above, in the conventional pop-up type container for wet tissues, the size of the container is limited by the width of the wet tissues. More specifically, the height of the container cannot be lower than the width of the wet tissues. Further, the amount of tissues cannot be increased even if the height of the container is made higher than the width of the wet tissues. In other words, the size of wet tissues to be contained in a container is limited by the size of the container.

In addition, in the above-described conventional pop-up type container, several turns of wet tissues closely adhere each other at the last end of the rolled tissue material, so that they are pulled upwardly in one body.

Accordingly, there is another problem that tissues at the last end of the roll cannot pass well through the aperture and that they are torn inadequately.

Apart from the above-described dispenser-container of a cylindrical type, dispenser-containers for wet tissues for portable sue have also been conventionally known. (For example, see Japanese Utility Model Publication No. Sho 59-2696.)

The conventionally known dispenser-container of wet tissues for portable use is a flat bag which usually contains about 10 tissues. The dispenser-container has an opening and a resealable flap for covering the opening. For example, the resealable flap may be made of a sheet having pressure sensitive adhesive coated on one side thereof, and the sheet is attached to the dispenser-container so that it covers the opening formed on the dispenser-container.

Another dispenser-container of a flat bag type has a U-shaped slit formed thereon, and the region surrounded by the slit is used as a flap while a small piece of sheet, which piece is larger than the flap, which piece has pressure sensitive adhesive coated thereon and which piece has an opening for dispensing the wet tissues therethrough, is attached to the portion corresponding to the above-described slit from the inside of the dispenser-container by the pressure sensitive adhesive.

Such a dispenser-container of a flat bag type contains wet tissues, which are separated in individual pieces, and accordingly, after one tissue is dispensed, the flap is closed until the next dispensing operation wherein the flap is opened again and the top one of tissues is dispensed.

The above-described dispenser-containers of a bag type for wet tissues can be manufactured at a cost lower than that required for the molded containers, because the dispenser-containers can be easily made of a flexible sheet material at a high manufacturing efficiency.

In such a dispenser-container, wet tissues separated in individual pieces are individually folded transversely and longitudinally in accordance with the size of the dispenser-container, and they are stacked and contained in the dispenser-container. Therefore, when large tissues are required to be contained in a small dispenser-container, the tissues have to be folded transversely and longitudinally for many times. However, when the folding process is complicated, the process cannot be done by a machine, and accordingly, the manufacturing efficiency is low. Thus, the size of tissues to be contained in a dispenser-container is similarly limited by the size of the dispenser-container.

Furthermore, in a conventional portable dispenser-container for wet tissues, there is another problem that the tissues located just below the uppermost tissue is picked up together with the uppermost tissue when the latter is required to be picked up.

In addition, since the wet tissues, which are in a wet condition, are folded transversely and longitudinally to form small pieces, they have to be spread in the transverse and longitudinal directions after they are taken out from the dispenser-container and before they are used. However, folded portions in the wet tissues which are in surface contact adhere to each other, and accordingly, it is difficult and troublesome to spread such adhering portions.

OBJECTS OF THE INVENTION

It is an object of the present invention to obviate the problems inherent to the conventional dispenser-container for wet tissues.

It is another object of the present invention to provide a dispenser-container for wet tissues wherein the size of a container and that of wet tissues contained in the container do not set a limit to each other, regardless of a type of the container, i.e., a cylindrical container or bag type dispenser-container.

It is a further object of the present invention to provide a dispenser-container wherein wet tissues having an optional size are contained in a container having an optional size.

It is still further object to provide a process for manufacturing such dispenser-containers and an apparatus for manufacturing the dispenser-containers.

SUMMARY OF THE INVENTION

According to the present invention, the above-described objects are achieved by a dispenser-container for wet tissues comprising wet tissues impregnated with liquid and a container having the wet tissues contained therein, characterized in that the tissues in a wet condition are formed in a rope-like or tape-like shape and are container in the container.

The rope-like or tape-like wet tissues may be made of a continuous sheet-like material which has weakened lines for separating therealong at a predetermined distance.

Alternatively, the rope-like or tape-like wet tissues may be made of a plurality of short tissues, adjacent edges of which are partially overlapped with each other.

The container may be a cylinder or box, or it may be made of a flexible and impervious sheet.

Further, the present invention provides a process for manufacturing such a dispenser-container for wet tissues, which process is characterized in that a long sheet-like tissue material is gathered in a widthwise direction so as to be formed in a rope-like shape and then is contained in a container, and that the tissue material is wetted before or after it is contained in the container.

The present invention further provides a process for manufacturing such a dispenser-container for wet tissues, which is characterized in that a plurality of short tissues are placed in such manner that parts of adjacent tissues are overlapping with each other and that they form a long sheet-like shape, and after the sheet-like shape material is gathered in a widthwise direction so as to be formed in a rope-like shape, the rope-like shape material is contained in a container, and that the tissue material is wetted before or after it is contained in the container.

In addition, the present invention provides a process for manufacturing a dispenser-container for wet tissues, which is characterized in that a long sheet-like tissue material is folded along a longitudinal direction so as to be formed in a tape-like shape and then is contained in a container, and that the tissue material is wetted before or after it is contained in the container.

Besides, the present invention provides a process for manufacturing such a dispenser-container for wet tissues, which is characterized in that a plurality of short tissues are placed in such manner that parts of adjacent tissues are overlapping with each other and that they form a long sheet-like shape, and after the sheet-like shape material is folded along a longitudinal direction so as to be formed in a tape-like shape, the tape-like shape material is contained in a container, and that the tissue material is wetted before or after it is contained in the container.

Further, the present invention provides an apparatus for manufacturing such a dispenser-container for wet tissues, which comprises:

- a means for continuously supplying tissue material;
- a means for gathering the tissue material in a widthwise direction so as to form in a rope-like or tape-like shape;
- a means for stacking or winding the gathered tissue material keeping its rope-like or tape-like shape; and
- a means for wetting the tissue material.

According to the present invention, after the tissue material to be in a wet condition is gathered in a widthwise direction so as to be formed in a rope-like shape or is folded along a longitudinal direction so as to be in a tape-like shape, it is contained in a container. Accordingly, the size of the wet tissue is not limited by the size of the container. In addition, the size of the wet tissue does not set a limit to the size of the container.

Thus, a dispenser-container for wet tissue can be obtained regardless of a cylindrical container type or a bag type wherein wet tissues of an optional size are contained in a container of an optional size.

Further, since wet tissue material is formed in a rope-like shape by gathering it in a widthwise direction, wet tissues do not adhere each other even at the last portion of the wet tissue material unlike the conventional wet tissues wound in a roll, and they can be taken up smoothly until the last piece.

Besides, when the wet tissue material is folded along the longitudinal direction to be formed in a tape-like shape, it can be taken up smoothly until the last piece unlike the conventional wet tissues wound in a roll.

Furthermore, since the wet tissue material is gathered in a widthwise direction so as to e formed in a rope-like shape or folded along a longitudinal direction so as to be in a tape-like shape, each wet tissue can be taken out easily one by one unlike the folded wet tissues in the conventional portable dispenser-container for wet tissues. According to the present invention, the wet tissues are formed in rope-like shape gathered in a widthwise direction or folded along a longitudinal direction but are not folded in both widthwise and lengthwise directions in a wet condition, they can be easily spreaded.

BRIEF DESCRIPTION OF THE DRAWINGS

The present invention will now be explained in detail based on the illustrated embodiments with reference to the accompanying drawings, wherein:

FIG. 5 (*b*) is a plan view which illustrates the arrangement and motion of a tube-like guide and a table which are used to draw the locus illustrated in FIG. 5 (*a*);

PREFERRED EMBODIMENTS

Figure 1:
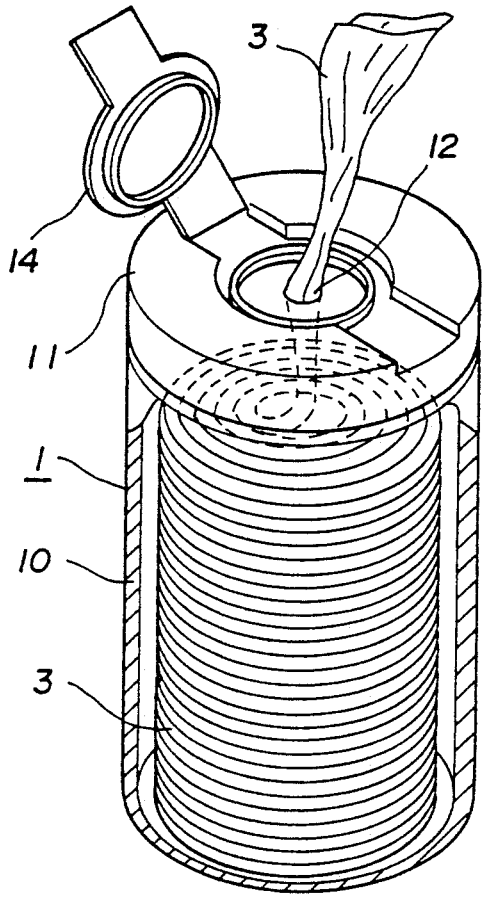
FIG. 1 is a perspective view, a part of which is broken out, and which illustrates an embodiment of a dispenser-container for wet tissues according to the present invention.

FIG. 1, is a perspective view, a part of which is broken out, and which illustrates an embodiment of a dispenser-container for wet tissues according to the present invention.

In the first embodiment of the dispenser-container for wet tissues according to the present invention, wet tissues 3 are impregnated with liquid, are being in a wet condition and are contained in a conventionally known cylindrical container 1.

The container 1 comprises a cylindrical container body 10 and a closure member 11 covered onto the container body 10, which are usually made of a synthetic resin and is blow molded or vacuum formed. The closure member 11 has an opening 12 for dispensing wet tissues 3 therethrough and a cap 14 for repeatedly opening and sealing the dispensing opening 12.

According to the present invention, the wet tissues 3 are different from the conventional set tissues in that the wet tissues 3 of the present invention are formed in a rope-like shape by gathering in a widthwise direction or in a tape-like shape by folding along a longitudinal direction. The wet tissues 3 of the present invention are contained in the container 1.

Materials which are used for wet tissues 3 may be, for example, fibrous materials, such as non-woven fabric, paper or gauze, or foam formed in a sheet.

Liquid which is impregnated into the tissue material may be, for example, liquid cosmetics, such as toilet water or milky lotion; drugs, such as an antiseptic or a medicine; cleaning solution for cleaning skin, including alcohol, moisturing agent, surfactant and so on; or solution for wiping stains in a kitchen, including alcohol, agent, surfactant and so on.

Figure 3:
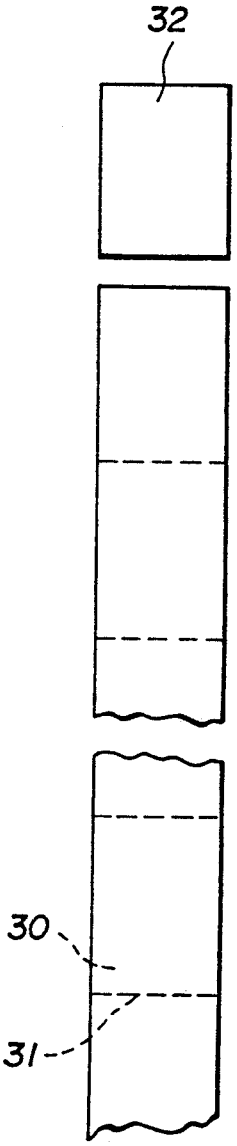
FIG. 3 is a plan view of a long sheet-like tissue material which is used in the present invention.

The wet tissues 3 of the present invention may be made of a long continuous sheet-like tissue material 30, which has perforated lines 31 transversely extending between its longitudinal sides at a predetermined distance for separating therealong in short individual pieces 32 as illustrated in FIG. 3, and which is formed in rope-like shape or tape-like shape.

Alternatively, the wet tissues 3 of the present invention may be made of a plurality of short tissues which are partially overlapped their edges with adjacent tissues and which are formed in a long rope-like or tape-like shape. In this case, since the tissues are wet when they are used and since the tissues are formed in a rope-like shape or a tape-like shape, they can be continuously taken out upon use because adjacent edges are overlapped and adhere with each other.

Figure 4:
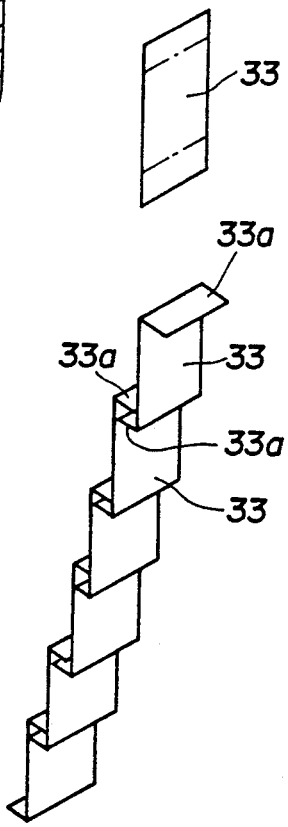
FIG. 4 is a perspective view which illustrates a condition wherein short tissue pieces which are used in the present invention are partially overlapped with each other.

When the tissue material is formed in a rope-like shape from a plurality of short tissues 33, it is possible that the edges of the tissues 33 are bent so that the bent portions 33*a* are engaged with each other as illustrated in FIG. 4.

Figure 2:
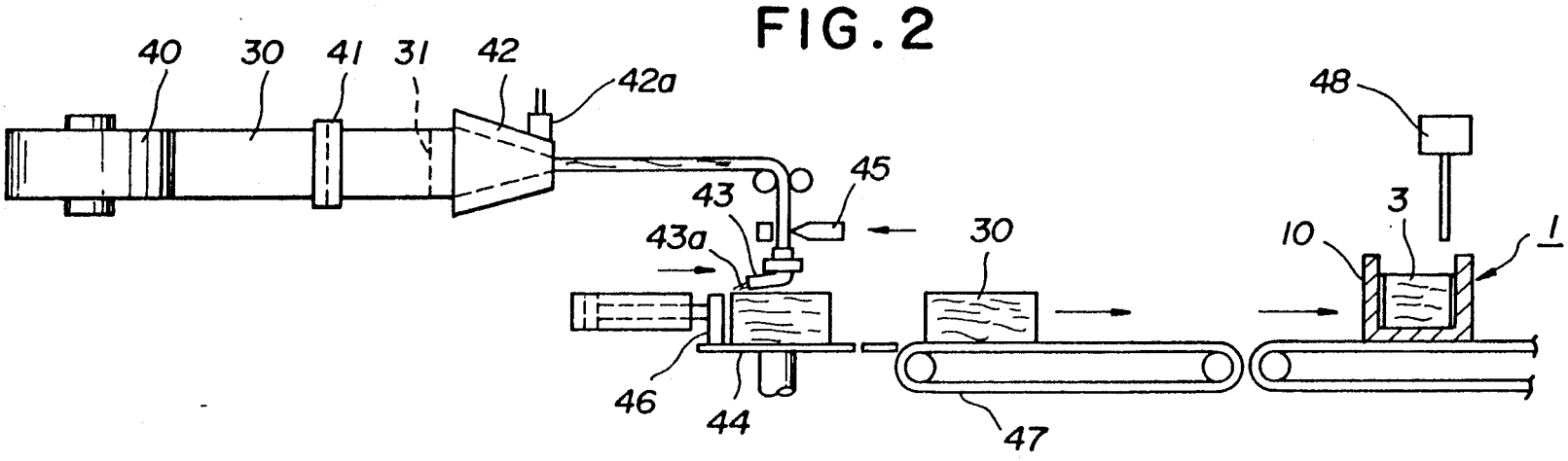
FIG. 2 is a flow sheet of an embodiment of a process for manufacturing a dispenser-container for wet tissues according to the present invention, a part of which is a plan view and the other part of which is a side view.

FIG. 2 is a flow sheet of an embodiment of a process for manufacturing a dispenser-container for wet tissues according to the present invention, a part of which is illustrated in a plan view and the other part of which is illustrated in a side view;

First, a continuous sheet-like tissue material 30 is withdrawn from a supply roll 40 for wet tissues. Then, transverse weakened lines 31, such as perforated lines, which are used to separate the tissue material 30 therealong, are formed on the tissue material 30 between its longitudinal sides at a predetermined distance in a longitudinal direction by a device 41 for forming perforated lines 31. The device 41 is of a conventionally known type. In place of formation of the weakened lines 31 on the tissue material 30 withdrawn from the supply roll 40, weakened lines 31 may be formed on tissue material 30 before the tissue material 30 is wound in a supply roll 40, and then the tissue material 30 with the weakened lines 31 may be wound to form supply roll 40.

Thereafter, the tissue material 30 is introduced into a tube 42 formed in a funnel shape, i.e., a shape with a large diameter at the side near the supply roll 40 and a small converged diameter at the opposite side, so that the tissue material 30 is gathered to be formed in a rope-like shape. Please note that the above-described steps are illustrated in a plan view in FIG. 2. In this case, it is preferred that moisture, such as steam, water or impregnating liquid, is appropriately added to the tissue material 30 before or after it enters into the funnel tube 42 or it is within the funnel tube 42 so that the tissue material 30 is moistened. In FIG. 2, a moistening device is designated by reference numeral 42*a*. Because of moistening, the tissue material 30 can be easily gathered, and the condition gathered in a rope-like shape can be readily maintained.

The device for forming the tissue material 30 in a rope-like shape is not limited to the funnel tube 42. Any device may be used regardless of its construction as long as it can gather a tissue material 30 in a widthwise direction. For example, a simple ring may be used for the device for forming the tissue material 30 in a rope-like shape.

Figure 5:
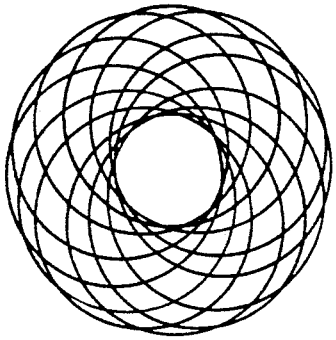
FIG. 5 (*a*) is a plan view which illustrates an embodiment of a locus along which a rope-like shape wet tissue material is stacked.
Figure 5:
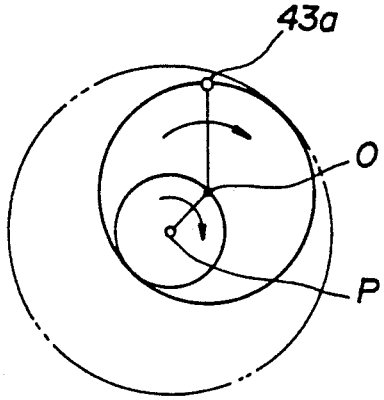

The tissue material 30 which has been formed in a rope-like shape in a foregoing manner is stacked in any optional shape by means of a suitable device. For example, the tissue material 30 is stacked in a coil shape as illustrated in FIG. 5 (*a*). In order to stack it as illustrated in FIG. 5 (*a*), a stacking method similar to the method for stacking sliver in a can by a coiler motion which has been applied in the cotton spinning field is acceptable. As illustrated in FIG. 2, wherein the steps which will be described below are illustrated in a side view, and FIG. 5 (*b*), a rotary center 0 of a tube guide 43 is arranged in such a manner that it deviates from a rotary center P of a table 44. The tissue material 30 formed in a rope-like shape is passed through the tube guide 43 and guided by the exit end 43*a* of the tube guide 43 while the tube guide 43 is rotated, and the tissue material 30 is stacked on the turn table 44 which is rotating. Thus, the rotary center 0 of the guide 43 draws a circle about the rotary center P of the turn table 44, and at the same time, the exit end 43*a* of the guide 43 also draws a circle about the rotary center 0 of the guide 43. As a result, the tissue material 30 is stacked in a vortical shape as illustrated in FIG. 5 (*a*).

In another method for stacking a tissue material 30, the tissue material 30 is dropped while the guide 43 is laterally traversed to and fro, and at the same time, the table 44 is traversed transversely to the traversing direction of the guide 43. As a result, the tissue material 30 may be stacked in a rectangular shape.

In a further stacking method, while the guide 43 is rotated, the radius of the rotary portion of the guide 43 is varied, i.e., increased and decreased. Alternatively, the position of the exit end of the guide 43 is slightly moved laterally while the table 44 is rotated. Thus, the tissue material 30 may be stacked in a cylindrical shape.

When a predetermined length of or a predetermined amount of tissue material 30 is stacked, the tissue material 30 is cut by a cutter 45. Then, the stacked tissue material 30 is conveyed from the table 44 to a conveyor 47 by a pushing device 46. Thereafter, the tissue material 30 is contained in the container body 10 of the container 1. Before or after the tissue material 30 is stored in the container 1, impregnating liquid is poured onto the tissue material 30 so as to wet the latter to form wet tissues 3. Please note that as shown impregnating liquid is poured onto the tissue material 30 by a wetting device 48 after the tissue material 30 is stored in the container 1 in FIG. 2.

In case that the tissue material 30 has been sufficiently wetted with impregnating liquid at, before or after the device 42 for forming a rope-like shape, application of impregnating liquid to the tissue material 30 at the final stage may be omitted.

In the foregoing embodiment, the tissue material 30 is stacked on the table 44. However, in place of stacking of the tissue material 30 on the table 44, the tissue material 30 formed in a rope-like shape may be wound on a bobbin, and then, the bobbin may be removed so that coreless cylindrical tissue material 30 is obtained.

Figure 6:
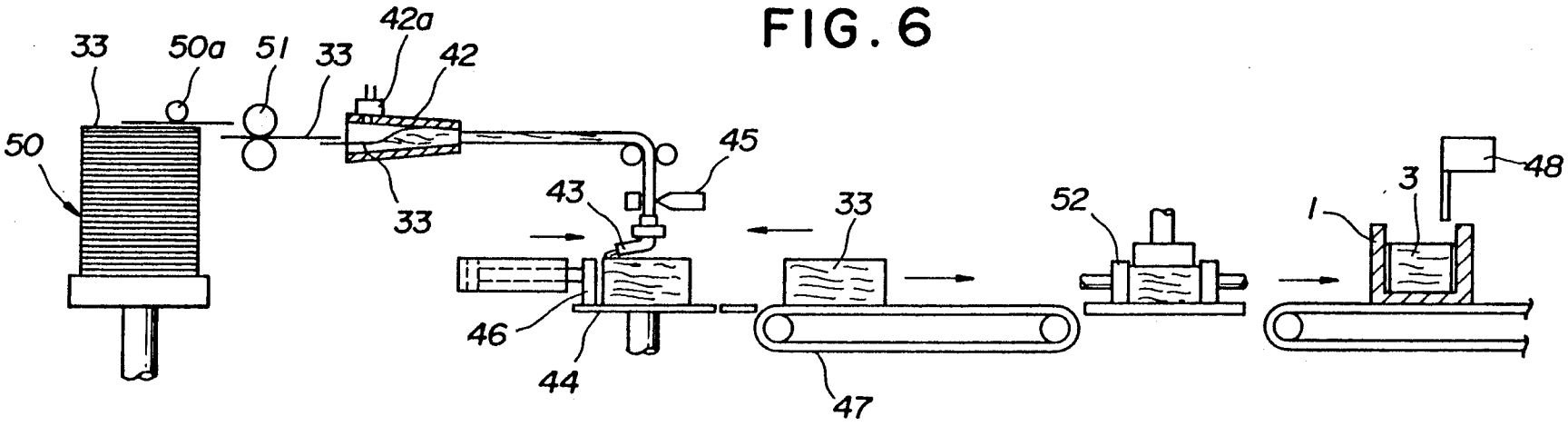
FIG. 6 is a side view illustrating another embodiment of a process for manufacturing a dispenser-container for wet tissues according to the present invention.

FIG. 6 is a flow sheet (a side view) illustrating another embodiment of a process for manufacturing a dispenser-container for wet tissues according to the present invention.

In this embodiment, short individually separated tissues 33 are used and are formed in a rope-like shape instead of a long continuous tissue material.

First, piled tissues 33, which tissues are cut in a predetermined size, are fed one by one from a device 50 for supplying tissues by means of a suitable device, such as a feed roller 50*a*. The fed tissues 33 are introduced by a feed roller 51 into a rope-like shape forming device 42 which gathers the tissue material 30 in a widthwise direction. In this case, the feed speeds of the tissue supply device 50 and the feed roller 51 are suitably adjusted in such a manner that ends of adjacent tissues 33 fed into the a rope-like shape forming device 42 partially overlap each other. Similarly, the take up speed of the tissue material formed in a rope-like shape form the rope-like shape forming device 42 is also suitably adjusted that the overlapping of the ends of the tissues 33 are maintained.

Thus, the tissues 33, which is formed in a thin and long sheet-like shape with adjacent ends partially overlapped with each other, is fed into the rope-like shape forming device 42 and is gathered in a widthwise direction of the long sheet-like shape to form a rope-like shape. In this case, similar to the foregoing process explained with reference to FIG. 2, it is preferred that moisture, such as steam, water or impregnating liquid, is appropriately applied before or after the rope-like shape forming device 42 or within the rope-like shape forming device 42 so that the tissue material 30 is moistened. In FIG. 6, moisture is applied within the rope-like shape forming device 42 by a moistening device 42*a*. It is most preferred that moisture is applied before the rope-like shape forming device 42.

After a plurality of tissues 33 have been gathered to form a tissue material in a rope-like shape, the tissue material is stacked on a table 44 in a foregoing manner explained with respect to FIG. 2.

When a predetermined length of or a predetermined amount of tissue material is stacked, the tissue material formed in a rope-like shape is cut by a cutter 45. Then, the stacked tissues 33 are conveyed from the table 44 to a conveyor 47 by a pushing device 46.

Then, peripheries of the stacked tissues 33 are pressed by a press 52 to shape in a desired shape, for example, a rectangular parallelepiped. The shaped tissues 33 formed in a rope-like shape is stored in a container 1. Like the method described above, impregnating liquid is poured onto the tissues 33 by a wetting device 48 to form wet tissues 3 before or after the tissues 33 are stored in the container 1. Then, the container 1 and a cap which is covered on the container 1 are packed.

Figure 7:
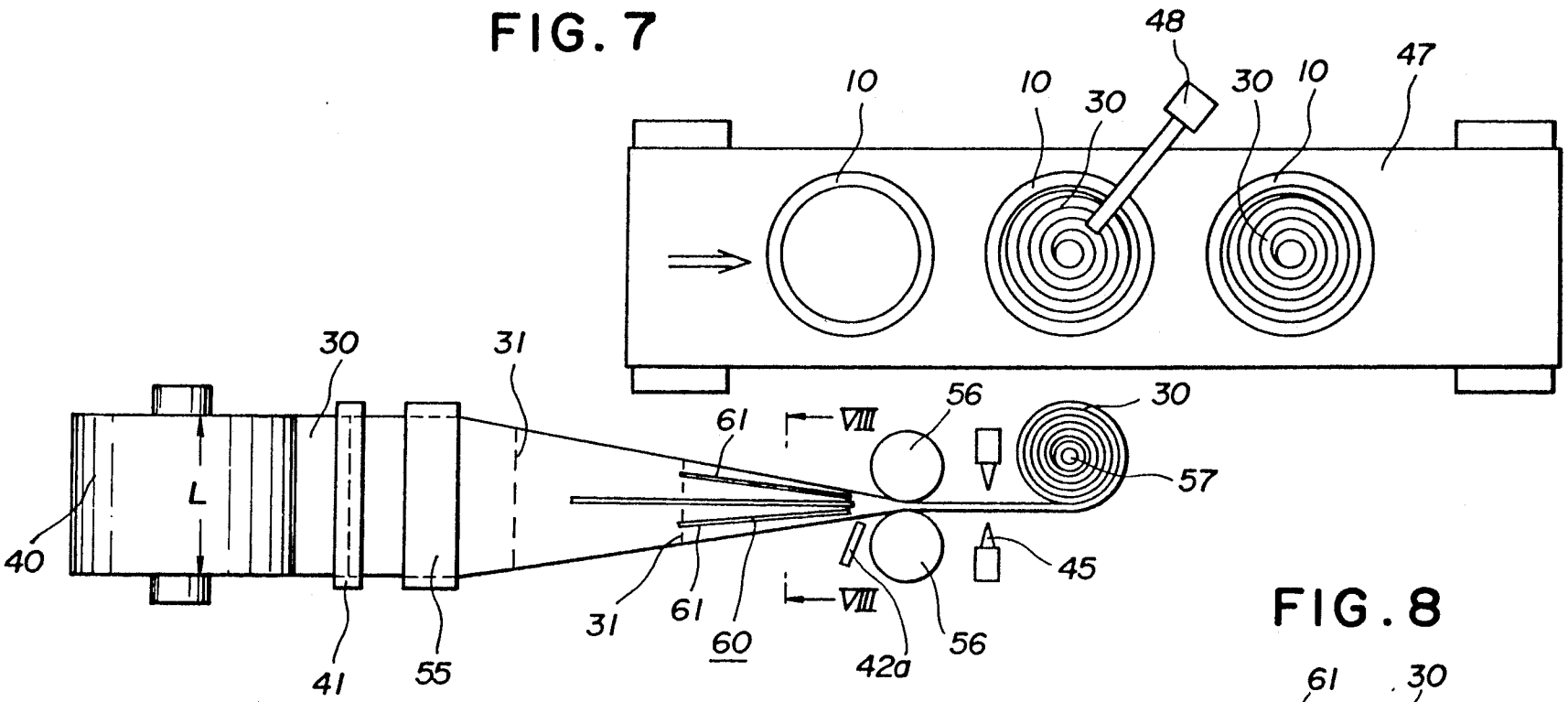
FIG. 7 is a plan view illustrating a still other embodiment of a process for manufacturing a dispenser-container for wet tissues according to the present invention.
Figure 8:
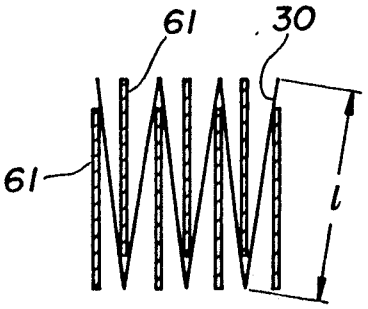
FIG. 8 is a sectional view taken along line VIII—VIII in FIG. 7.

FIG. 7 is a flow sheet (a plan view) illustrating a still other embodiment of a process for manufacturing dispenser-container for wet tissues according to the present invention. FIG. 8 illustrates an embodiment of a folding device and is a sectional view taken along line VIII—VIII in FIG. 7.

First, a continuous sheet-like tissue material 30 is withdrawn from a supply roll 40 for wet tissues. Then, weakened lines 31, such as perforated lines, which are used to separate the tissue material 30 therealong, are formed transversely to the tissue material 30 at a predetermined distance in its longitudinal direction by a device 41 for forming perforated lines 31.

In place of arrangement of the perforated line forming device 41 before the folding device 60, the perforated line forming device 41 may be disposed after the folding device 60 so that weakened lines 31 for separating tissues therealong are formed by the perforated line forming device 41.

In place of formation of the weakened lines 31 on the tissue material 30 withdrawn from the supply roll 40, perforated lines may be formed on tissue material 30 before the tissue material 30 is wound in a supply roll 40, and then the tissue material 30 may be wound to form supply roll 40.

Thereafter, the tissue material 30 is introduced into the folding device 60 by a feed roller 55 and is folded into a tape-like shape with a narrow width by the folding device 60.

In this embodiment, the folding device 60 comprises a plurality of folding plates 61 disposed above and below the tissue material 30 as illustrated in FIG. 8. The folding plates 61 are so arranged that they are spaced at the side near the supply roll and that they are narrowed at the opposite side when they are seen in a plan view as illustrated in FIG. 7. It is preferred that the degree of engagement of the upper and lower folding plates 61 is gradually increased from the side near the supply roll to the opposite side.

Thus, the long sheet-like tissue material 30 is folded along the longitudinal direction when it passes by a space between the folding plates 61, so that it is formed in a tape-like shape, the width of which 1 is smaller that the original width L. It is preferred that the width 1 of the tape-like shape is not larger than a half of the original width L, and preferably is not larger than one third of the original width L. In the embodiment illustrated in FIG. 8, the tissue material 30 is folded into a tape-like shape having a width of one sixth of the original width L. The width of the folded tape-like shape is not specifically limited, however, it is suitable to be between 0.5 and 8 cm.

The folded tissue material 30 is then introduced between a pair of press rollers 56 so that it is well creased. In this case, it is preferred that moisture, such as stream, water or impregnating liquid, is appropriately applied before or after the press rollers 56. Because of moistening, creases of the tissue material 30 can be readily maintained, and the condition in a tape-like shape can be maintained.

The device for folding the tissue material 30 in a tape-like shape is not limited to the embodiment illustrated in FIG. 8. Any device may be used regardless of its construction as long as it can fold a tissue material 30 in a longitudinal direction.

The tissue material 30 thus formed in a tape-like shape is once wound on a bobbin 57, and the tissue material 30 is cut by a cutter 45 when a predetermined length of or a predetermined amount of tissue material 30 is wound. Then, the bobbin is removed so that coreless cylindrical tissue material 30 is obtained.

When the tissue material 30 formed in a tape-like shape is wound, it may be traversed along the longitudinal direction of the bobbin 57 or may not be traversed. It may be wound while it is in a tape-like shape. Alternatively, it may be gathered to form a rope-like shape by passing through a guide having an appropriate shape, for example, a ring guide, and then, it may be wound.

The tissue material 30 wound in a coreless cylindrical shape is contained in a container body 10 of a container 1 which is conveyed by a conveyor 47. Before or after the tissue material 30 is stored int eh container 1, impregnating liquid is poured to the tissue material 30 so as to wet the latter to from wet tissues 3. Then, a cap (not shown) is put on the container body 10 of the container 1, and the cap and the dispenser-container of the present invention is obtained.

When the tissue material 30 is sufficiently wetted because it has been supplied with impregnating liquid before or after the folding device 60, application of impregnating liquid to the tissue material 30 at the final stage may be omitted.

Figures 9, 10:
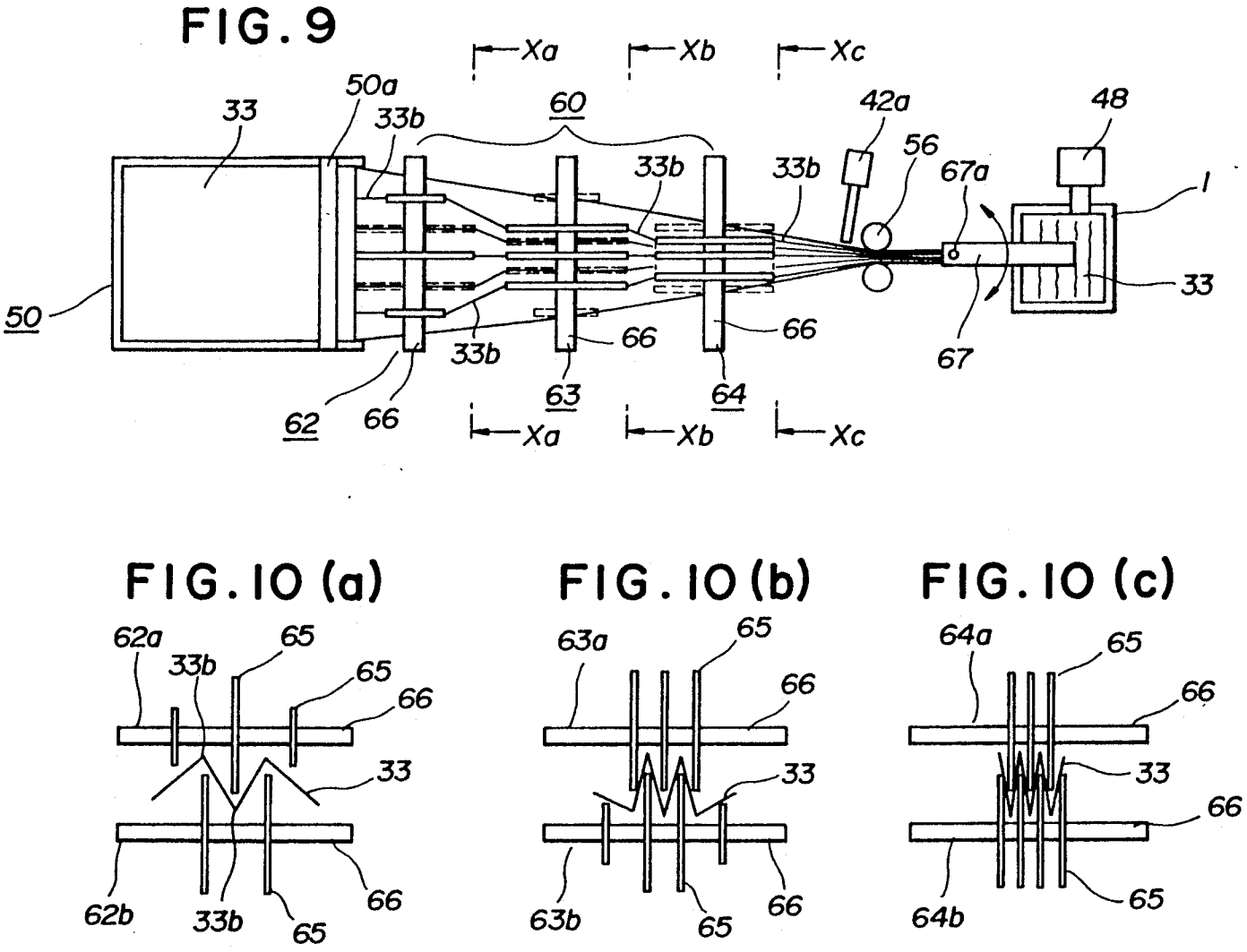
FIG. 9 is a plan view illustrating a further embodiment of a process for manufacturing a dispenser-container for wet tissues according to the present invention.
FIGS. 10 (*a*), (*b*) and (*c*) illustrate pairs of folding rollers and are views seen in directions designated by arrows Xa, Xb and Xc in FIG. 9, respectively.

FIG. 9 is a flow sheet (a plan view) illustrating a further embodiment of a process for manufacturing a dispenser-container for wet tissues according to the present invention.

In this embodiment, short individually separated tissues are used similarly to that illustrated in FIG. 6. but they are formed in a tape-like shape different from the embodiment illustrated in FIG. 6.

First, piled tissues 33 which are cut in a desired size are fed one by one from a device, which is generally designated by reference numeral 50, for supplying tissues by means of a suitable device, such as a feed roller 50*a*. The fed tissues 33 are fed into a folding device 60 which folds the tissues along the longitudinal direction.

The folding device 60 in this embodiment comprises a plurality of pairs of folding rollers 62, 63 and 64 as illustrated in FIG. 9.

Each pair of folding rollers are, as illustrated in FIGS. 10 (*a*) to 10 (*c*), a pair of folding rollers 62*a* and 62*b*, 63*a* and 63*b*, and 64*a* and 64*b*, each of which comprises a plurality of discs 65 and s spindle 66 to which the discs 65 are attached.

The distance between the adjacent discs 65 on the same spindle 66 in the pairs 62, 63 and 64 of folding rollers is decreased from in the pair of folding rollers 62, which are located at the supply side of the tissues 33, to in the pair of folding rollers 63 and 64 away from the supply side as illustrated in FIGS. 9 and 10.

The depth of engagement of the upper and lower discs 65 on the pair of folding roller 62 is the largest at the center part and smaller at both the sides as illustrated in FIG. 10(*a*). The depth of engagement of the upper and lower discs 65 on the pair of folding roller 63 is also the largest at the center and smaller at both the sides as illustrated in FIG. 10(*b*). The depth of engagement of the upper and lower discs 65 on the pair of folding roller 64 is all the same as illustrated in FIG. 10 (*c*).

When the distance between the discs 65 and the depths of the engagement of the pairs of folding rollers 62, 63 and 64 are varied as described above, the creases 33*b* can be formed well on the tissues 33.

The pairs of folding rollers 62, 63 and 64 are rotated and are provided with a capability for feeding the tissues 33. In this case, the feed speeds of the tissue supply device 50 and the pairs of folding rollers 62, 63 and 64 are suitably adjusted in such a manner that ends of adjacent tissues 33 fed into the folding device 60 are partially overlapped with each other.

The tissues 33 fed from the folding device 60 is taken up by a pair of press roller 56 and is creased well. Similarly, the take up speed of the tissue material formed in a tape-like shape by the press rollers 56 is also suitably adjusted that the overlapping of the ends of the tissues 33 are maintained.

Thus, the tissues 33, which is formed in a thin and long sheet-like shape with adjacent ends partially overlapped with each other, is fed into the folding device 60 where they are folded in a longitudinal direction of the thin sheet-like shape to form a tape-like shape. In this case, similar to the foregoing processes, it is preferred that moisture, such as stream, water or impregnating liquid, is appropriately applied to the tissues 33 before or after or at the folding device 60 by a moistening device 42*a* so that the tissues 33 are moistened.

After a plurality of tissues 33 have been formed in a tape-like shape, they are stacked in the container 1 through a guide 67 which swivels about a pivot 67*a*. Alternatively, the tissues 33 may be stacked on the table in a manner similar to that explained with reference to the embodiments illustrated in FIGS. 2 and 6. When a predetermined length of or a predetermined amount of tissue material is stacked, the tissue material formed in a tape-like shape is cut by a cutter (not shown). Impregnating liquid is poured to the tissues 33 by a wetting device 48 to form wet tissues 3 before or after the tissues 33 are stored in the container 1. Then, a cap is covered on the container 1. Thus, the dispenser-container of the present invention is obtained.

Figure 11:
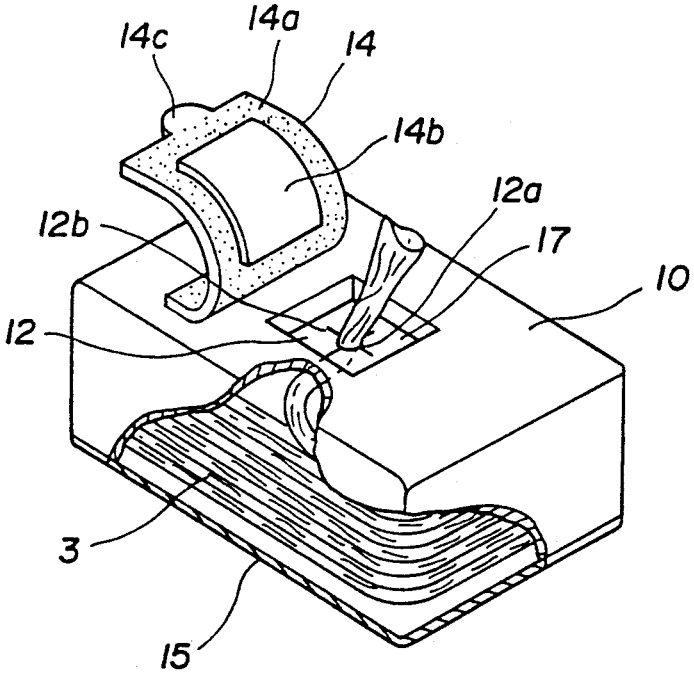
FIG. 11 is a perspective view, a part of which is broken out, and which illustrates another embodiment of a dispenser-container for wet tissues according tot eh present invention.

FIG. 11 is a partially broken out perspective view illustrating another embodiment of a dispenser-container for wet tissues according to the present invention.

In this embodiment, the wet tissues 3 formed in a rope-like shape or a tape-like shape are shaped in a rectangular parallelepiped and are stored in a square container 1.

The container 1 comprises: a main body 10 formed in a rectangular parallelepiped and provided with open bottom; and a bottom plate 15 sealingly covering the open bottom of the main body 10. The main body 20 has a recess 16 at around the center of the top surface thereof. A dispensing opening 12 is formed on the bottom 17 of the recess 16 so that the wet tissues 3 formed in a rope-like shape or a tape-like shape can be dispensed through the opening 12. Further, a flap 14 is disposed on the top surface of the main body 10 in such a manner that the flap 14 is disposed on the top surface of the repeatedly opened and sealingly closed the recess 16.

The main body 10 of the container 1 may be made of a synthetic resin and is blow molded or vacuum formed integrally with the recess. In this case, it is preferred that the thickness of the container is set relatively thin. If the thickness is large as a whole, it is recommended that at least the bottom 17 of the recess 16 is thinned.

The material and the construction of the flap 14 are not limited as long as the flap can be repeatedly opened and sealingly closed. It is preferred that an end of the flap 14 is fixed to the main 10 body by any suitable method, for example, adhesive or heat sealing.

The flap 14 illustrated in FIG. 11 is made of a liquid impervious sheet, and it has a pressure sensitive adhesive 14*a*, such as polyester, acrylic or rubber adhesive, applied to one side of the flap 14, i.e., the side contacting with main body 10, except for a grip portion 14*c*. This flap is simple in its construction. The pressure sensitive adhesive 14*a* may be applied to the entire surface of one side. However, in order to prevent wet tissues 3 from being adhered by the pressure sensitive adhesive 14*a* when they are dispensed, it is preferred that the pressure sensitive adhesive 14*a* is applied to only the periphery of the flap 14 or that as illustrated in FIG. 11 a piece of sheet 14*b* is adhered to apportion corresponding to the recess while the pressure sensitive adhesive 14*a* may be applied to the entire surface.

After the wet tissues 3 formed in a rope-like shape or a tape-like shape are stored in the main body 10 of the container 1, which has the above-described construction, from its open bottom, the bottom plate 15 is attached to the main body 10. The material and the construction of the bottom plate 15 are not limited as long as the bottom plate can be sealingly attached to the main body 10. For example, a liquid impervious sheet is used for the bottom plate 15 and is permanently secured to the open bottom of the main body 10 of the container 1 by means of adhesive or heat sealing.

When the bottom plate 15 is permanently secured as described above, this embodiment is different form that illustrated in FIG. 1 in that the wet tissues 3 cannot be picked up by removing the closure member 11. Accordingly, the shape of the dispensing opening 12 which is formed at the bottom 17 of the recess 16 is so designed that fingers of a user can be entered therethrough so that the user can access the wet tissues 3 formed in a rope-like shape or a tape-like shape. For this purpose, as illustrated in FIG. 11, the dispensing opening 12 comprises a small aperture 12 a and several slits 12*b* extending from the small aperture 12*a*.

When the dispenser-container of the present invention is used first, fingers of a user are inserted into the dispensing opening 12: Then the opening 12 is widened because of the existence of the slits 12*b* and the bottom 17 is deformed. Accordingly, the wet tissues 3 can be picked up by the fingers. In case that the tissue material is long and continuous, a picked up wet tissue 3 is torn at a weakened line 31 from the succeeding wet tissues 3 by the resistance caused by the small aperture 12*a*. In case that the tissue material comprises a plurality of short tissues, a picked up piece of wet tissue 3 is separated from the succeeding tissues 3 by the small aperture 12*a*.

As described above, when the wet tissues 3 are picked up, a part of the succeeding wet tissues 3 also comes out through the opening 12. However, the latter wet tissue 3 is held by the small aperture 12*a* of the opening 12. Accordingly, the succeeding wet tissue 3 remains in a condition wherein only a part of the wet tissue is exposed outside. The exposed portion of the wet tissue 3 can be accommodated within the recessed portion 16. After the desired number of the wet tissues 3 are taken out, the flap 14 is closed again and is adhered to the top surface of the container 1. Thus, the container 1 recovers its sealed condition.

Figure 12:
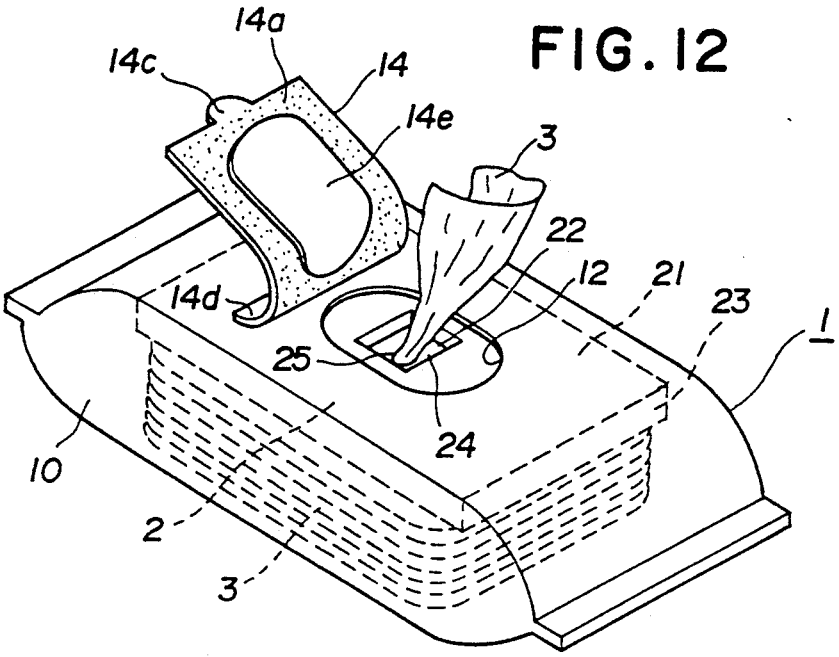
FIG. 12 is a perspective view illustrating a still other embodiment of a dispenser-container for wet tissues according to the present invention.

FIG. 12 is a perspective view illustrating a still other embodiment of a dispenser-container for wet tissues according to the present invention.

The dispenser-container for wet tissues of the present embodiment comprises a resealable container 1 of a pillow type which is made of flexible sheet, a tray member 2 which is made of a material harder than that of the container 1, and wet tissues 3 formed in a rope-like shape or a tape-like shape. The tray member 2 and the wet tissues 3 are illustrated by broken lines in FIG. 12.

The resealable container 1 has an opening 12 for dispensing the wet tissues 3, which are formed in a rope-like shape or a tape-like shape, therethrough and a flap 14 for covering the opening 12, and the construction of the container may be similar to that of the conventionally known portable dispenser-container of a bag type for wet tissues.

The flexible sheet constituting a container body 10 may be a film made of synthetic resins such as polyethylene, polypropylene, polyester, polyamide, and polyvinyl chloride, and the film may be a single layer or a laminated layer. The film may be a laminated layer of the above-mentioned film and an aluminum foil or paper.

The sheet constituting a container body 10 may be gas impervious or liquid impervious depending on the king of the liquid impregnated in wet tissues 3. For example, when the impregnating liquid contains perfumes which easily violates, it is preferred to sue a sheet which is impervious to both gas and liquid.

In the embodiment illustrated in FIG. 12, the flap 14 of the container 1 is a piece of a sheet which is independent from the container body 10. The material of the flap 14 may be a liquid impervious sheet which is similar to that of the container body 10. In this embodiment, both the sheet of the container body 10 and the flap 14 are liquid impervious.

The flap 14 has a pressure sensitive adhesive 14*c*, such as polyester, acrylic or rubber adhesive, applied to one side of the flap 14, i.e., the side contacting with container body 10, except for a grip portion 14*c*. The flap 14 can be repeatedly adhered to and removed from the container body 10 while it covers the dispensing opening 12 formed in the container body 10 or the weakened line for forming the dispensing opening 12.

It is preferred that an end 14*d* of the flap 14 opposite to the grip 14*c* is fixed to the container body 10 by heat sealing or adhesive or that the flap 14 has at the end 14*d* slits extending from its sides or U-shaped slits so that the slits prevent the end portion 14*d* from being removed.

The dispensing opening 12 formed in the container body 10 may be formed in any suitable shape, such as an ellipse, a circle, a rectangle or a rhombus. When the dispensing opening 12 is formed by a weakened line, the weakened line may be a perforated line when it is seen in the plan view of the container body 10 or may be a V-shaped slit when it is seen in a cross sectional view taken along the thickness direction of the sheet forming the container body 10. The weakened line is formed on the container body 10 to form a closed loop or an open loop such as U-shaped when it is seen in the plan view of the container body 10.

When the flap 14 is opened first to use the wet tissues 3, the portion 14*e* surrounded by the closed loop or the open loop is removed from the container body 10 and is kept to be attached to the flap 14 (see FIG. 12), and the area, from which the portion 14*e* is removed, becomes the dispensing opening 12.

As illustrated in FIG. 12, the tray member 2 is contained within the container 1 and is located between the wet tissues 3 and the top surface of the container 1, i.e., the surface which surface has the dispensing opening 12 formed therein and the flap 14 attached thereto and which surface is opposite to the bottom surface.

The tray member 2 has a flat or substantially flat top surface 21 and a recessed portion 22 formed at almost the center of the top surface 21. The tray member 2 preferably comprises side wall 23 connected to peripheries of the top surface 21. The bottom surface 24 of the recessed portion 22 of the tray member 2 has a dispensing opening 25 formed therein, which opening is used to dispense wet tissues 3 formed in a rope-like shape or a tape-like shape. The dispensing opening 25 formed in the tray member 2 may be formed in any suitable shape as long as fingers can be inserted therethrough to pick up a rope-like shaped or a tape-like shaped wet tissues 3, and the picked up wet tissues 3 can be held by the opening 25, similar to the dispensing opening 12 formed in the recessed portion 16 of the embodiment illustrated in FIG. 11.

In the embodiment illustrated in FIG. 12, when the flap 14 is opened first to use the wet tissues 3, the recessed portion 22 of the tray member 12 is located just below the dispensing opening 12. Therefore, the user can insert his or her fingers into the container 1 through the dispensing opening 25 of the tray member 12 and pick up the wet tissues 3 contained within the container 1.

Similar to the embodiment explained with reference to FIG. 11, a part of the succeeding wet tissues 3, which will be use next time, also comes out together with the wet tissue 3 which will be used present. However, the end of the succeeding wet tissues 3 is held by the dispensing opening 25. Then, the container 1 recovers its sealed condition, when the flap 14 is adhered to the container 1 again.

In the embodiment illustrated in FIG. 12, since the container 1 is a dispenser-container made of a flexible sheet-like material, the container 1 is deformable. Accordingly, when the amount of the wet tissues 3 is decreased as they are dispensed, the container 1 can be flat. Therefore, if the wet tissue 3 for the next use cannot be dispensed well through the dispensing openings 25 of the tray member, the set tissue 3 is easily accessible through the opening 25 regardless of the remaining amount of the wet tissues 3 in the container 1.

It was explained that the container 1 in the above-described embodiment is of a pillow type. However, the dispenser-container made of a flexible sheet-like material is not limited to of a pillow type, and a three sided seal bag or a tube provided with sealed ends may be used. In these cases, similar to the embodiment illustrated in FIG. 12, it is preferred that a sheet-like flap having pressure sensitive adhesive coated thereon is disposed, and it is preferred that a tray member having a dispensing opening, which opening can hold wet tissues 3, is inserted within the dispenser-container. For example, one end of a tube, which is made of a liquid impervious sheet, is sealed to form a bag. And wet tissue material, which has been stacked in a cylindrical shape, is inserted into the bag, and a tray member is put on the wet tissue material, or the wet tissue material is inserted after the tray member has been inserted into the tube. Then, the open end of the bag is sealed to form the dispenser-container for wet tissues of the present invention. In this case, it is preferred that a dispensing opening and a flap have been previously disposed on one side, i.e., the side where the tray member locates, before the wet tissue material is stored.

Figure 13:
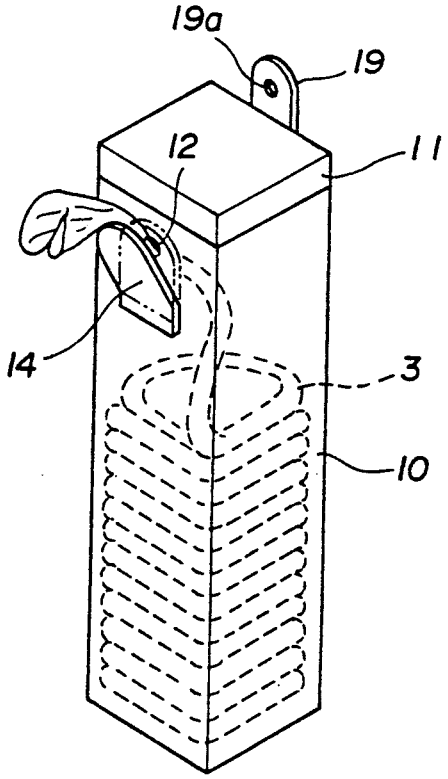
FIG. 13 is a perspective view illustrating a further embodiment of a dispenser-container for wet tissues according to the present invention.

FIG. 13 is a perspective view illustrating a further embodiment of a dispenser-container for wet tissues according to the present invention.

The dispenser-container for wet tissues of the present embodiment comprises a main body 10 and a closure member 11 covered onto the container body 10. The main body 10 has an opening 12 for dispensing wet tissues 3 therethrough and a flap 14 for repeatedly opening and sealing the dispensing opening 12. Further a mount 19, which is provided with an engaging hole 19*a*, is attached to the main body 10 so that the dispenser-container can be hung on wall. The closure member is removable, and a user can freely access wet tissues 3 contained int he main body 10, when the closure member is removed. Therefore, the main body 10 is not required to be deformable, and it may have a large depth.

The dispenser-containers for wet tissues of the present invention are not limited to the above-described embodiments. Especially, the container 1 may have any construction, shape and material as long as it is liquid impervious and hermetically sealed.

ADVANTAGES OF THE INVENTION

According to the present invention, a tissue material in a wet condition, which as been formed in a rope-like shape or in a tape-like shape, is contained in a container. Accordingly, the size of the wet tissue is not limited by the size of the container. In addition, the size of the wet tissue does not set a limit to the size of the container. Further, the amount of wet tissues contained in the container is not limited by the size of the wet tissues and can be varied at will be changing the size of the container.

Thus, a dispenser-container for wet tissues can be obtained regardless of a cylindrical container type or a bag type wherein wet tissues of an optional size are contained in a container of an optional size.

Further, since wet tissue material is formed in a rope-like shape or tape-like shape, excessive wet tissues are not picked up from the container when they are used, and they can be taken up smoothly one by one until the last piece. Accordingly, the wet tissues are not wasted.

Especially, when wet tissue material is formed in a rope-like shape, they can be easily opened.

What is claimed is:

1. A process for manufacturing a dispenser containing wet tissues which comprises: supplying a plurality of individual tissues with the ends of adjacent individual tissues partially overlapping to form a long web-like element; transversing gathering said web-like element into a transversely irregularly crushed rope-like body of tissue material; placing substantially the entire length of said rope-like body of tissue material in a container and wetting said tissue material during said process.

2. A process for manufacturing a dispenser containing wet tissues which comprises: supplying a long sheet of tissues material having longitudinally spaced transverse lines of weakening for facilitating separation of individual tissues of predetermined size; transversely gathering said long sheet of tissue material into a transversely irregularly crushed rope-like body of tissue material; placing substantially the entire length of said rope-like body of tissue material in a container and wetting said tissue material during said process.

3. An apparatus for manufacturing a dispenser-container for wet tissues which comprises:

means for continuously supplying tissue material;

means for transversely irregularly gathering said tissue material to form said tissue material into a transversely irregularly crushed rope-like body; means for placing said rope-like body of tissue material in a container; and means for wetting said tissue material.

4. An apparatus of claim 3 further comprising means for providing said tissue material in separable form so that tissues of a predetermined length can be withdrawn from said container.

5. An apparatus of claim 4 wherein means for perforating said tissue material at predetermined longitudinal intervals is provided so that tissues of predetermined length can be withdrawn from said container.

6. An apparatus of claim 4 wherein means are provided for producing a long web-like element from a plurality of individual tissues by partially overlapping the ends of adjacent individual tissues so that individual tissues of a predetermined length can be withdrawn from the container.

* * * * *

UNITED STATES PATENT AND TRADEMARK OFFICE

CERTIFICATE OF CORRECTION

PATENT NO. : 5,152,121

DATED : October 6, 1992

INVENTOR(S) : K. Nakamura

It is certified that error appears in the above-identified patent and that said Letters Patent is hereby corrected as shown below:

Col. 4, line 26 "tissue" should read --tissues--; line 41, after "to", "e" should read --be--.

Col. 5, line 15, after "invention", delete period ".", insert semicolon --;--; line 26, after "according", "tot eh" should read --to the--; line 53, "set" should read --wet--.

Col. 8, line 43, after "manufacturing" insert --a--.

Col. 9, line 29, "stream" should read --steam--; line 56, after "stored" "int eh" should read --in the--; line 58, "from" should read --form--.

Col. 10, line 60, "stream" should read --steam--.

Col. 11, line 20, after "body", "20" should read --10--; line 27, after "14" delete "is disposed on the top surface of the", insert --can be--; line 52, after "to" (first occurrence), "apportion" should read --to a portion--; line 67, "form" should read --from--.

UNITED STATES PATENT AND TRADEMARK OFFICE

CERTIFICATE OF CORRECTION

PATENT NO. : 5,152,121

DATED : October 6, 1992

INVENTOR(S) : K. Nakamura

It is certified that error appears in the above-identified patent and that said Letters Patent is hereby corrected as shown below:

Col. 12, line 61, "king" should read --kind--; line 63, "sue" should read --use--.

Col. 14, line 51, "int he" should read --in the--.

Col. 15, line 2, "be" (second occurrence) should read --by--;

Signed and Sealed this

Seventh Day of December, 1993

*Attest:*

*Attesting Officer*

BRUCE LEHMAN

*Commissioner of Patents and Trademarks*